US009845779B2

(12) United States Patent
Imoehl et al.

(10) Patent No.: US 9,845,779 B2
(45) Date of Patent: Dec. 19, 2017

(54) COATED HIGH PRESSURE GASOLINE INJECTOR SEAT TO REDUCE PARTICLE EMISSIONS

(71) Applicant: Continental Automotive Systems, Inc., Auburn Hills, MI (US)

(72) Inventors: William James Imoehl, Williamsburg, VA (US); Hong Zhang, Tegernheim (DE)

(73) Assignee: Continental Automotive Systems, Inc., Auburn Hills, MI (US)

( * ) Notice: Subject to any disclaimer, the term of this patent is extended or adjusted under 35 U.S.C. 154(b) by 360 days.

(21) Appl. No.: 14/315,942

(22) Filed: Jun. 26, 2014

(65) Prior Publication Data

US 2015/0377198 A1 Dec. 31, 2015

(51) Int. Cl.
*F02M 53/04* (2006.01)
*F02M 61/18* (2006.01)
(Continued)

(52) U.S. Cl.
CPC ..... *F02M 53/046* (2013.01); *F02M 51/0685* (2013.01); *F02M 61/166* (2013.01);
(Continued)

(58) Field of Classification Search
CPC ..... F02M 53/046; F02M 51/0685; F02M 61/166; F02M 61/1833; F02M 61/1886;
(Continued)

(56) References Cited

U.S. PATENT DOCUMENTS 4,817,873 A 4/1989 McKay
5,173,339 A * 12/1992 Singer ..... B23P 15/002 29/890.129

(Continued)

FOREIGN PATENT DOCUMENTS

CN 1076998 A 10/1993
CN 101338717 A 1/2009

OTHER PUBLICATIONS

Masao Kinoshita et al., A Method for Suppressing Formation of Deposits on Fuel Injector for Direct Injection Gasoline Engine, Society of Automotive Engineers, Inc., vol. 1999-01-03656, 1999, pp. 25-32.

(Continued)

*Primary Examiner* — Arthur O Hall
*Assistant Examiner* — Juan C Barrera

(57) ABSTRACT

A fuel injector has a seat and at least one seat passage. The seat includes an outer tip surface through which the seat passage extends. A non-thermally conducting coating is provided on at least a portion of the outer tip surface and not on surfaces defining the seat passage. The coating is constructed and arranged to be heated by combustion gases so that the outer tip surface reaches a temperature greater than a temperature that the outer tip surface would reach if the coating was not provided so as to cause evaporation of fuel that contacts the outer tip surface, The seat passage is constructed and arranged to not be substantially heated by conduction from the outer tip surface and to be cooled by fuel passing there-through so as to prevent deposits of combustion from accumulating on surfaces defining the seat passage.

16 Claims, 3 Drawing Sheets

(51) Int. Cl.
*F02M 51/06* (2006.01)
*F02M 61/16* (2006.01)

(52) U.S. Cl.
CPC .... *F02M 61/1833* (2013.01); *F02M 61/1886* (2013.01); *F02M 2200/06* (2013.01); *F02M 2200/9038* (2013.01)

(58) Field of Classification Search
CPC ..... F02M 2200/06; F02M 2200/9038; F02M 61/1826; F02M 61/1806
USPC ..... 239/533.2, 569–586
See application file for complete search history.

(56) References Cited

U.S. PATENT DOCUMENTS 5,551,638 A 9/1996 Caley
6,267,307 B1 * 7/2001 Pontoppidan ..... F02M 61/06 239/104
6,502,769 B2 * 1/2003 Imoehl ..... F02B 33/44 239/533.12
6,755,024 B1 6/2004 Mao et al.
6,845,920 B2 1/2005 Sato et al.
7,051,961 B2 * 5/2006 Mills ..... F02M 51/0682 239/533.2
7,896,262 B2 3/2011 Suzuki et al.
2005/0242212 A1 11/2005 Chapaton et al.
2009/0025680 A1 * 1/2009 Kihara ..... F02B 23/104 123/299
2010/0224706 A1 9/2010 Suzuki et al.
2011/0147493 A1 6/2011 Mitsuoka et al.
2013/0048748 A1 2/2013 Imoehl

OTHER PUBLICATIONS

Wikipedia contributors, "Thermal barrier coating", Wikipedia, The Free Encyclopedia, Feb. 25, 2014, 10:22 UTC, https://en.wikipedia.org/w/index.php?title=Thermal_barrier_coating&oldid=597050781 (accessed Jun. 26, 2014).
Chinese Office Action and English translation dated Mar. 27, 2017, for counterpart Chinese application No. 201510617599.8.
Chinese Decision on Rejection, dated Aug. 29. 2017 for corresponding Chinese Application No. 201510617599.8.

* cited by examiner

COATED HIGH PRESSURE GASOLINE INJECTOR SEAT TO REDUCE PARTICLE EMISSIONS

FIELD

The invention relates to gasoline direct injection for vehicles and, more particularly, to providing a non-thermally conducting coating on a fuel injector tip to increase a temperature thereof and thus reduce particulate emissions.

BACKGROUND

Particulate emissions of gasoline engines will be newly regulated in Europe in 2014 with the introduction of EU6a regulations of $6\times10^{12}$ particles/km and further reduced to $6\times10^{11}$ particles/km with the introduction of EU6c in 2017. Similarly, United States regulations will impose similarly challenging standards with the introduction of LEVIII. Standards are assumed to be 10 mg/mi in 2014, 3 mg/mi in 2018 and 1 mg/mi in 2025. A major source of particulate emissions is known to be from a diffusion flame fed by fuel evaporating from the deposits on the fuel injector tip.

It is known that protruding the fuel injector further into the combustion chamber reduces the particulate emissions. Increasing injector tip protrusion raises injector tip temperature by exposing more injector tip surface area to hot combustion gases. This in turn enhances evaporation of any fuel remaining on the tip so there is no or little fuel remaining on the tip to be ignited when the flame front passes. The higher tip temperature also enhances oxidation of the deposits on the tip reducing the sponge-like surface of the deposits which hold the fuel.

Increasing tip temperature enhances evaporation on the external surfaces of the tip lowering particulate emissions, but it also increases the temperature of the fuel metering orifices or passages. This increases the risk of deposits being formed in the metering passages themselves. It is well known that fuel characteristics, tip (orifice) temperatures, fuel pressure and nozzle design affect deposit formation in injector flow passages. It is generally accepted that if the tip temperatures are kept below 120° C., that no problems with deposit related flow shift will be encountered. This guideline is only achievable with side mounted direct injectors. In centrally mounted injector applications, temperatures up to 300° C. can be seen.

Thus, there is a need to increase the injector tip temperature to lower particulate emissions while allowing the metering passages of the injector to be cooled by the fuel to prevent deposit formation in the passagers and thus prevent flow shift.

SUMMARY

An object of the invention is to fulfill the need referred to above. In accordance with the principles of the embodiments, this objective is obtained by providing a fuel injector having an inlet, an outlet, and a passageway providing a fuel flow conduit from the inlet to the outlet. The fuel injector includes a valve structure movable in the passageway between a first position and a second position. A seat, at the outlet, has at least one seat passage in communication with the passageway. The seat contiguously engages a portion of the valve structure in the first position thereby closing the at least one seat passage and preventing fuel from exiting the at least one passage. The valve structure in the second position is spaced from the at least one seat passage so that fuel can move through the passageway and exit through the at least one seat passage. The seat includes an outer tip surface through which the least one seat passage extends. A non-thermally conducting coating is provided on at least a portion of the outer tip surface and not on surfaces defining the at least one seat passage. The coating is constructed and arranged to be heated by combustion gases so that the outer tip surface reaches a temperature greater than a temperature that the outer tip surface would reach if the coating was not provided, so as to cause evaporation of fuel that contacts the outer tip surface after injection. The at least one seat passage is constructed and arranged to not be substantially heated by conduction from the outer tip surface and to be cooled by fuel passing there-through so as to prevent deposits of combustion from accumulating on surfaces defining the at least one seat passage.

In accordance with another aspect of a disclosed embodiment, a method reduces particulate emissions associated with a fuel injector. The fuel injector has an inlet; an outlet; a passageway providing a fuel flow conduit from the inlet to the outlet; a valve structure movable in the passageway between a first position and a second position; a seat, at the outlet, having at least one seat passage in communication with the passageway. The seat contiguously engages a portion of the valve structure in the first position thereby closing the at least one seat passage and preventing fuel from exiting the at least one passage. The valve structure in the second position is spaced from the at least one seat passage so that fuel can move through the passageway and exit through the at least one seat passage. The seat includes an outer tip surface through which the at least one seat passage extends. The method coats a non-thermally conducting material on at least a portion of the outer tip surface and not on surfaces defining the at least one seat passage. The coating is heated by combustion gases during operation of the fuel injector so that the outer tip surface reaches a temperature greater than a temperature that the outer tip surface would reach if the coating was not provided, thereby enhancing evaporation of fuel on the outer tip surface and thus reducing particle emission. The method cools surfaces defining the at least one seat passage with fuel passing there-through so that the surfaces are at a temperature less than a temperature of the outer tip surface to ensure that fuel remaining in the at least one passage after injection is in a liquid state, thereby preventing deposits of combustion from accumulating on surfaces defining the at least one seat passage.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
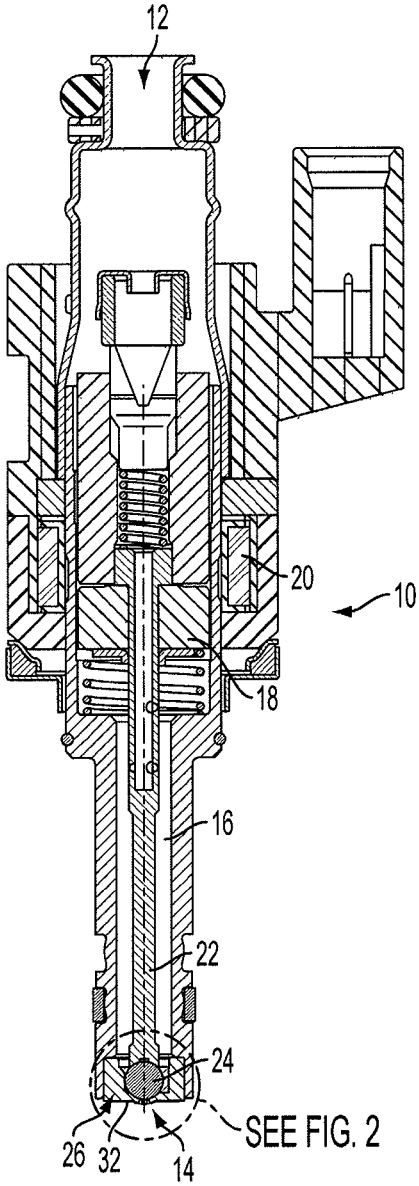
FIG. 1 is a view of gasoline direct fuel injector provided in accordance with an embodiment.

With reference to FIG. 1, a gasoline direct fuel injector is shown, generally indicated at 10, in accordance with an embodiment of the invention. The fuel injector 10 has a fuel inlet 12, a fuel outlet 14, and a fuel passageway 16 extending from the fuel inlet 12 to the fuel outlet 14. The injector 10 is of the conventional, solenoid-operated type, having an armature 18 operated by a coil 20. Electromagnetic force is generated by current flow from the electronic control unit (not shown) through the coil 20. Movement of the armature 18 also moves an operatively attached needle 22 and ball valve 24 to positions that are either separated from or contiguously engaged with a seat, generally indicated at 26. The needle 22 and ball valve 24 define valve structure of the injector 10. Instead of providing the ball valve 24, it can be appreciated that the valve structure could only comprise the needle 22, with an end of the needle engaging the seat 26.

Figure 2:
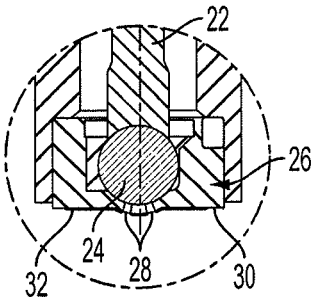
FIG. 2 is an enlarged view of the portion encircled at 2 in FIG. 1.

Movement of the ball valve 24 opens or closes, respectively, the at least one metering orifice or seat passage 28 (FIG. 2) through the seat 24, which permits or inhibits, respectively, fuel from flowing through the fuel outlet 14 of the fuel injector 10. In the embodiment a plurality of metering seat passages 28 are shown. More or fewer passages 28 can be provided depending on the application. The passages 28 extend through an outer tip surface 30 of the seat 26. The outer tip surface 30 defines an end of the fuel injector 10 and can be considered to be the injector tip face.

In accordance with an embodiment, an insulative coating 32 is provided on at least a portion of the outer tip surface 30. The coating 32 permits the surface temperature of the tip surface 30 to increase and, at the same time, allows the seat passages 28 to be cooled more effectively by the fuel passing there-through. The hot tip surface 30 reduces particle emissions and the cool seat passages 28 minimize the risk of deposit related flow loss. In the embodiment, the coating 32 surrounds, without obstructing, all of the seat passages 28.

Figure 3:
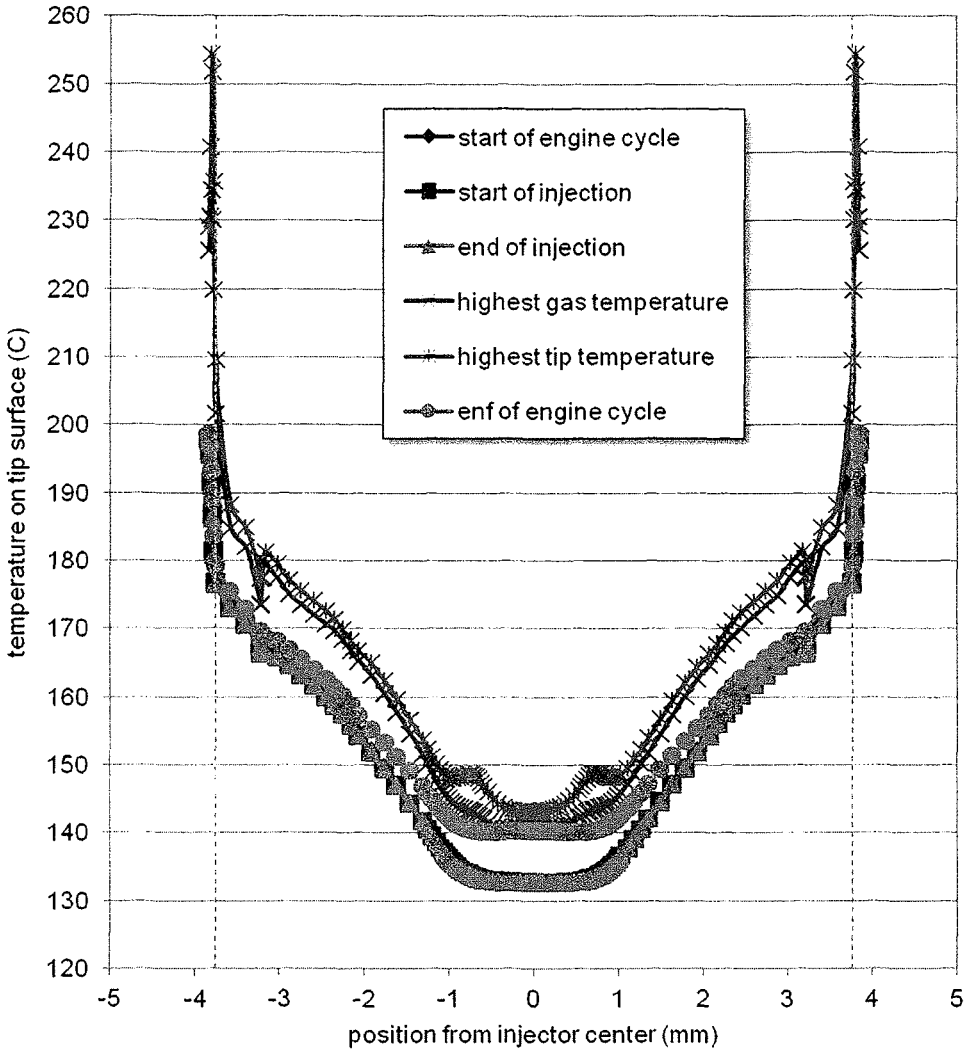
FIG. 3 is a plot showing the surface temperature of the injector tip surface at different points in the engine cycle.

It has been shown through measurements and modeling that the flow of fuel through the seat 26 has a major influence on the temperatures encountered on the seat 26. The plot shown in FIG. 3 shows the surface temperature of the injector tip surface 30 at different points in the engine cycle. The plot shows that the high temperatures of combustion raise the tip surface 30 temperature and the injection of fuel lowers it.

In the embodiment, the steel outer tip surface 30 is coated with a non-thermally conducting material 32. The passages 28 are drilled through the more thermally conductive steel portion of the seat 26. The outer tip surface 30 is coated in such a way to allow the fuel to exit the steel surfaces defining the passages 28 with minimal contact with the coated tip surface 30. In this way, the passages 28 are cooled and wetted with fuel during injection but are not substantially heated through conduction from the large surface area of the tip surface 30 exposed to the heat of combustion. The low temperature (lower than that of the outer tip surface) in the passages 28 allows what fuel remains there after injection to remain liquid and not form deposit precursors. The coated tip surface 30, being insulated, is readily heated by the combustion gases and reaches higher temperatures than the same geometry would reach if it was not coated. Any fuel that contacts this hot surface readily evaporates and is less likely to form deposits and/or a diffusion flame creating particulates.

The material of the coating 32 preferably falls into the class of materials known as thermal barrier coatings. These are typically ceramic coating systems most commonly containing yttria-stabilized zirconia or other rare earth zirconates. However, the coating is not limited to zirconia or zirconates. The thickness of the coating 32 depends on the material selection and application method. A target thickness is preferably less than 0.25 mm.

Figures 4A, 4B, 4C, 4D:
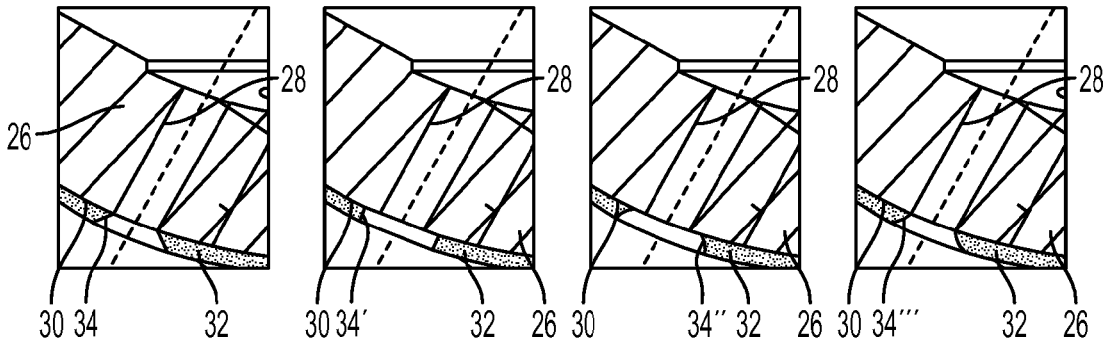
FIGS. 4A-4D show embodiments of an interface between the coating and an exit a metering passage.

FIGS. 4A-4D show various example shapes of surface features defining an exit of the passage 28. In particular, FIG. 4A shows an exit surface feature 34 of the passage 28 to be of conical shape. FIG. 4B shows an exit surface feature 34' of the passage 28 to be of stepped shape. FIG. 4C shows an exit surface feature 34" of the passage 28 to be defined by an internal radius and FIG. 4D shows an exit surface feature 34'" of the passage 28 to be defined by an external radius. The exit surface features 34, 34', 34" and 34'" are preferably provided entirely within the coating 32 by machining, laser machining, masking or the like and define the interface between the insulating coating 32 and the cylindrical passage 28. The embodiments of the exit surface features depend on the coating material, thickness and application method.

Figures 5A, 5B, 5C:
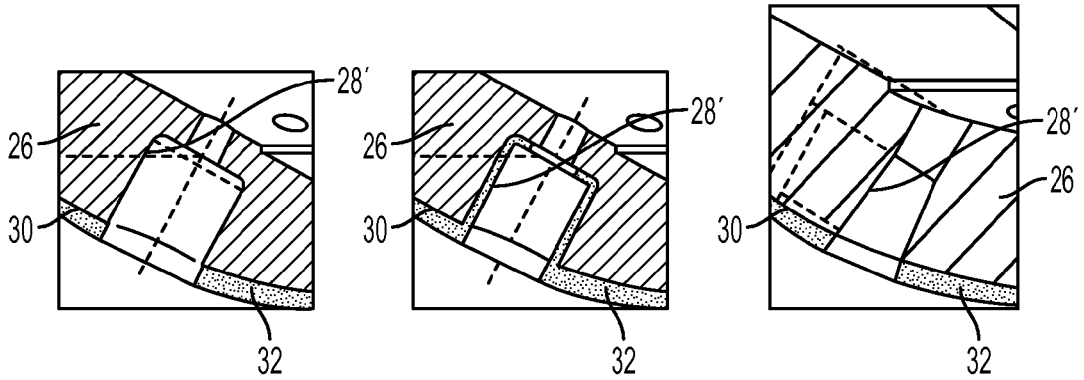
FIGS. 5A-5C show embodiments of coating of stepped metering passages.

FIGS. 5A-5C show example embodiments of stepped passages 28'. Depending on the nature of the coating 32, its thickness and application method, a stepped passage 28' may be masked, preventing application of the coating inside the step leaving a surface on the edge of the coating parallel to the step surface. This coating 32 can be applied to conical (FIG. 5C) or cylindrical (FIG. 5A) passages 28'. In the case of a cylindrical step, it may be desirable to coat the inside of the step (FIG. 5B) to enhance the evaporation of any fuel that may be left in the step after injection. The details of the exit surface feature at the exit of the metering passage 28' at the bottom of the step could be the same as those depicted in FIGS. 4A-4D.

Thus, the embodiments ensure that the temperature of the tip surface 30 is maintained as high as possible to lower particle emission and ensure that the temperature of the surfaces of the passages 28 is as low as possible so as to limit fuel deposits forming in the passages and thus prevent flow shift that is caused by fuel deposits.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector having an inlet, an outlet, and a passageway providing a fuel flow conduit from the inlet to the outlet, the fuel injector comprising:

a valve structure movable in the passageway between a first position and a second position;

a seat, at the outlet, having at least one seat passage in communication with the passageway, the seat contiguously engaging a portion of the valve structure in the first position thereby closing the at least one seat passage and preventing fuel from exiting the at least one seat passage, the valve structure in the second position being spaced from the at least one seat passage so that fuel can move through the passageway and exit through the at least one seat passage, the seat including an outer tip surface through which the at least one seat passage extends, the at least one seat passage is of generally stepped shape, the stepped seat passage having a first cylindrical shape extending away from the valve structure and a second cylindrical shape extending away from the first cylindrical shape, the first cylindrical shape having a diameter that is less than a diameter of the second cylindrical shape; and a non-thermally conducting coating on at least a portion of the outer tip surface and not on surfaces defining the at least one seat passage, being constructed and arranged to be heated by combustion gases during injection so that the outer tip surface reaches a temperature greater than a temperature that the outer tip surface would reach if the coating was not provided, so as to cause evaporation of fuel that contacts the outer tip surface, wherein the at least one seat passage is constructed and arranged to not be substantially heated by conduction from the outer tip surface and to be cooled by fuel passing there-through so as to prevent deposits of combustion from accumulating on surfaces defining the at least one seat passage.

2. The fuel injector of claim 1, wherein the outer tip surface is a steel surface and the coating is a thermal barrier material.

3. The fuel injector of claim 2, wherein the coating is a ceramic coating.

4. The fuel injector of claim 3, wherein the coating contains a rare earth zirconate.

5. The fuel injector of claim 1, wherein the at least one seat passage includes an exit surface feature provided entirely within the coating.

6. The fuel injector of claim 5, wherein the exit surface feature is conical or stepped shaped.

7. The fuel injector of claim 5, wherein the exit surface feature includes an internal or external radius.

8. A method of reducing particulate emissions associated with a fuel injector, the fuel injector having an inlet; an outlet; a passageway providing a fuel flow conduit from the inlet to the outlet; a valve structure movable in the passageway between a first position and a second position; a seat, at the outlet, having at least one seat passage in communication with the passageway the at least one seat passage is of generally stepped shape, the stepped seat passage having a first cylindrical shape extending away from the valve structure and a second cylindrical shape extending away from the first cylindrical shape, the first cylindrical shape having a diameter that is less than a diameter of the second cylindrical shape, the seat contiguously engaging a portion of the valve structure in the first position thereby closing the at least one seat passage and preventing fuel from exiting the at least one passage, the valve structure in the second position being spaced from the at least one seat passage so that fuel can move through the passageway and exit through the at least one seat passage, the seat including an outer tip surface through which the least one seat passage extends, the method comprising:

coating a non-thermally conducting material on at least a portion of the outer tip surface and not on surfaces defining the at least one seat passage, the coating being heated by combustion gases during operation of the fuel injector so that the outer tip surface reaches a temperature greater than a temperature that the outer tip surface would reach if the coating was not provided, thereby enhancing evaporation of fuel on the outer tip surface and thus reducing particle emission; and cooling surfaces defining the at least one seat passage with fuel passing there-through so that the surfaces are at a temperature less than a temperature of the outer tip surface to ensure that fuel remaining in the at least one passage after injection is in a liquid state, thereby preventing deposits of combustion from accumulating on surfaces defining the at least one seat passage.

9. The method of claim 8, wherein the outer tip surface is a steel surface and the step of coating provides a thermal barrier material on at least a portion of the outer tip surface.

10. The method of claim 9, wherein the coating is a ceramic coating.

11. The method of claim 9, wherein the coating contains a rare earth zirconate.

12. The method of claim 8, wherein the at least one seat passage includes an exit surface feature provided entirely within the coating.

13. The method of claim 12, wherein the exit surface feature is conical or stepped shaped.

14. The method of claim 12, wherein the exit surface feature includes an internal or external radius.

15. A fuel injector having an inlet, an outlet, and a passageway providing a fuel flow conduit from the inlet to the outlet, the fuel injector comprising:

a valve structure movable in the passageway between a first position and a second position;

a seat, at the outlet, having at least one seat passage in communication with the passageway, the seat contiguously engaging a portion of the valve structure in the first position thereby closing the at least one seat passage and preventing fuel from exiting the at least one seat passage, the valve structure in the second position being spaced from the at least one seat passage so that fuel can move through the passageway and exit through the at least one seat passage, the seat including an outer tip surface through which the at least one seat passage extends, the at least one seat passage is of generally stepped shape, the stepped seat passage having a first cylindrical shape extending away from the valve structure and a second cylindrical shape extending away from the first cylindrical shape, the first cylindrical shape having a diameter that is less than a diameter of the second cylindrical shape; and a non-thermally conducting coating on at least a portion of the outer tip surface and on at least a portion of surfaces defining the second cylindrical shape of at least one seat passage, the coating being constructed and arranged to be heated by combustion gases during injection so that the outer tip surface reaches a temperature greater than a temperature that the outer tip surface would reach if the coating was not provided, so as to cause evaporation of fuel that contacts the outer tip surface, wherein the at least one seat passage is constructed and arranged to not be substantially heated by conduction from the outer tip surface and to be cooled by fuel passing there-through so as to prevent deposits of combustion from accumulating on surfaces defining the at least one seat passage.

16. A method of reducing particulate emissions associated with a fuel injector, the fuel injector having an inlet; an outlet; a passageway providing a fuel flow conduit from the inlet to the outlet; a valve structure movable in the passageway between a first position and a second position; a seat, at the outlet, having at least one seat passage in communication with the passageway the at least one seat passage is of generally stepped shape, the stepped seat passage having a first cylindrical shape extending away from the valve structure and a second cylindrical shape extending away from the first cylindrical shape, the first cylindrical shape having a diameter that is less than a diameter of the second cylindrical shape, the seat contiguously engaging a portion of the valve structure in the first position thereby closing the at least one seat passage and preventing fuel from exiting the at least one passage, the valve structure in the second position being spaced from the at least one seat passage so that fuel can move through the passageway and exit through the at least one seat passage, the seat including an outer tip surface through which the least one seat passage extends, the method comprising:

coating a non-thermally conducting material on at least a portion of the outer tip surface and on at least a portion of surfaces defining the second cylindrical shape of the at least one seat passage, the coating being heated by combustion gases during operation of the fuel injector so that the outer tip surface reaches a temperature greater than a temperature that the outer tip surface would reach if the coating was not provided, thereby enhancing evaporation of fuel on the outer tip surface and thus reducing particle emission; and cooling surfaces defining the at least one seat passage with fuel passing there-through so that the surfaces are at a temperature less than a temperature of the outer tip surface to ensure that fuel remaining in the at least one passage after injection is in a liquid state, thereby preventing deposits of combustion from accumulating on surfaces defining the at least one seat passage.

* * * * *